United States Patent [19]

Shook et al.

[11] 4,106,597

[45] Aug. 15, 1978

[54] EXECUTIVE FOOD CARRYING CASE

[75] Inventors: Robert L. Shook; Howard D. Sirak, both of Columbus, Ohio

[73] Assignee: Executive Products Corporation, Columbus, Ohio

[21] Appl. No.: 842,064

[22] Filed: Oct. 14, 1977

[51] Int. Cl.[2] ..... A45C 11/20

[52] U.S. Cl. ..... 190/42; 206/545

[58] Field of Search ..... 206/545, 542, 588, 591, 206/592; 220/4 F; 150/2.1, 1.6; 190/11, 42

[56] References Cited

U.S. PATENT DOCUMENTS

| | | | |
|---|---|---|---|
| 108,989 | 11/1870 | Elcon | 206/545 |
| 1,889,765 | 12/1932 | Smither | 190/42 |
| 2,555,126 | 5/1951 | Grene | 206/545 |
| 3,016,129 | 1/1962 | King | 206/545 |
| 3,025,947 | 3/1962 | Hammer | 206/545 |
| 3,347,346 | 10/1967 | Young | 190/11 |
| 3,633,785 | 1/1972 | Cyr | 206/545 |
| 3,845,875 | 11/1974 | Douglas | 206/545 |
| 3,850,333 | 11/1974 | Reichert | 206/545 |
| 3,915,304 | 10/1975 | Rasco | 206/545 |
| 3,938,688 | 2/1976 | Ryan | 206/545 |

*Primary Examiner*—Herbert F. Ross

*Attorney, Agent, or Firm*—Frank H. Foster

[57] ABSTRACT

A food carrying, attache' case contains a removable insert in which food, papers and documents are transported. The insert is a block of thermally insulating foam formed with cavities which matingly receive food and beverage containers and utensils. A covering lid is hinged to the foam block and has a layer of resilient, insulating foam bonded to its underside so that closing of the lid compressibly retains the food containers in the cavities. The top of the lid is sufficiently smooth and flat to form a writing work surface. A pressure sensitive latching means is provided for at times holding the lid closed and at times fastening the lid to the opened part of the attache' case to hold the lid open during use.

3 Claims, 5 Drawing Figures

EXECUTIVE FOOD CARRYING CASE

BACKGROUND OF THE INVENTION

This invention relates generally to food transporting articles and more particularly relates to a food carrying case having the exterior appearance of an attache' case and the interior functional structure to provide for convenient and effective carrying, preservation and protection of food and carrying of papers.

Many people find it desirable, necessary or both to carry their lunch with them on a regular basis to their place of business or employment. In spite of the fact that this provides improved ease and convenience, time savings, money savings and a wider opportunity for variety and for foods tailored to an individual's preferences, many people find carrying a lunch to work to be a source of embarrassment. Some believe it to be injurious to their image.

While paper sacks and lunch boxes have been available for such use, these are often cumbersome to carry and offer little protection against food spoilage.

Therefore, it is desirable to provide a suitable structure for conveniently obtaining all of the advantages of carrying one's lunch but to do so in such a way that it is not apparent that the user is in fact carrying a lunch. To this end it is desirable to provide a lunch carrying case which not only has the exterior appearance and therefore the prestige of a briefcase or attache' case but also can effectively and efficiently transport food in a manner that the food will be safely preserved and available to be served and enjoyed at an appropriate temperature at any convenient time during the day.

Others have suggested the carrying of food in attache' cases having specially and permanently constructed interior structures. Such specially constructed cases deprive the owner of the option of using the case solely as an attache' case and often deprive the owner of using the case simultaneously for both carrying food and for carrying business papers.

One limiting disadvantage with most such previously suggested modified attache' cases is that the permanent nature of their food carrying structures makes washing and cleaning difficult and possibly destructive of the case. Still others have suggested designs which do not provide insulation which permits food items to be stored and retained at widely divergent temperatures such as would be appropriate for hot soup and cold milk.

OBJECTS AND SUMMARY OF THE INVENTION

It is therefore an object of the present invention to provide a food carrying case which permits people to take advantage of the savings in time and money, the availability of a broader selection of food and the opportunity for following a specialized or preferred diet, such as a religious, health or weight loss diet, while at the same time doing so in a manner that appeals to the prestige or status minded person.

It is still another object of the present invention to provide a food carrying case which has the external appearance of an attache' case, which when opened continues to conceal the carrying of food and additionally provides a space for carrying papers and a convenient work surface on which paper work can be accomplished, for example while commuting to work.

A still further object of the present invention is to provide a food carrying case which can effectively protect food both from undesirable temperature increases or decreases and also from physical damage or trauma.

Still another object of the present invention is to provide an insert which can convert a conventional attache' case to the specialized function of carrying food on a temporary basis while permitting the continued use of the attache' case for its conventional paper carrying function.

In summary, the invention has an insert which can be removably placed in an attache' case to facilitate its use for the carrying of food. The insert comprises a block of insulative material which is smaller than the interior of the attache' case and has a plurality of food receiving cavities formed into one of its major surfaces. A covering lid is pivotally mounted to the block over the major surface having the cavities for at times protectively covering and retaining the food items in those cavities.

Further objects and features of the invention will be apparent from the following specification and claims when considered in connection with the accompanying drawings illustrating the preferred embodiment of the invention.

Figure 1:
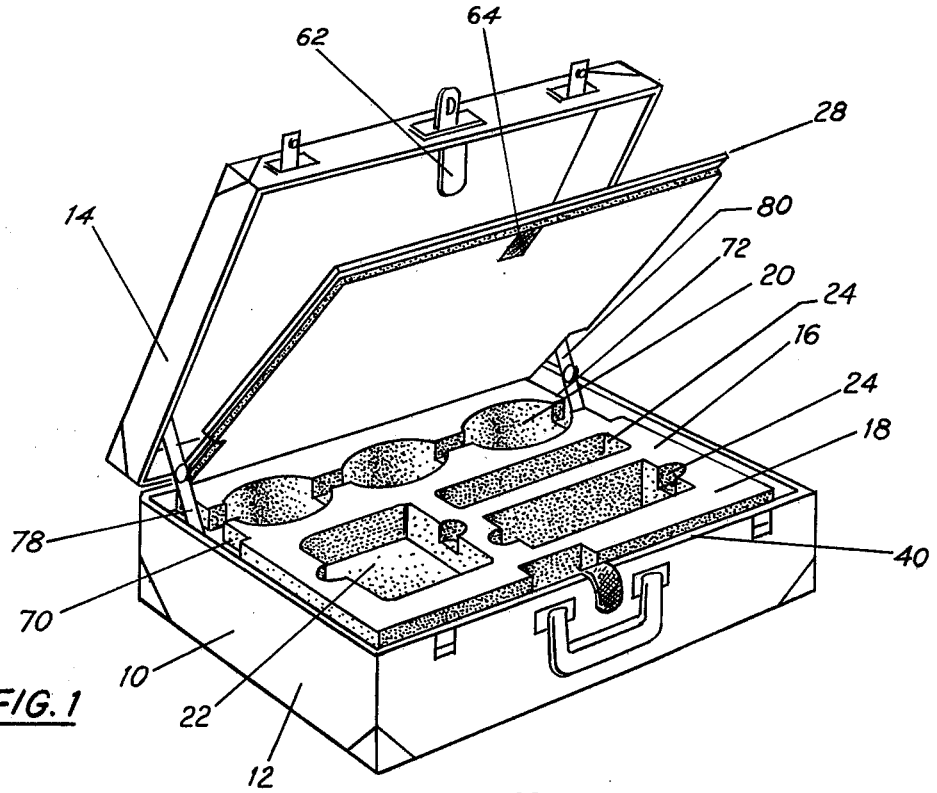
FIG. 1 is a view in perspective of an entire food carrying case embodying the present invention showing the lid of the insert opened to reveal the cavities formed in the insulative block.

In describing the preferred embodiment of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DETAILED DESCRIPTION

Referring now to FIG. 1, the preferred embodiment of the invention has an attache' case 10 which includes a main base member 12 and a top 14 which is hingedly secured to the base member 12 along their co-extensive rear edges. The attache' case or brief case is essentially a conventional case modified only as described below. There are of course a great variety of sizes, shapes and designs for such cases and the embodiment of the invention contemplates use of these various types of similar cases.

A food containing insert, designated generally as 16, is removably positioned within the attache' case 10. This insert 16 comprises a block of insulative material 18 which is smaller than the interior of the attache' case so that the attache' case can be closed about it but extends into contact with the interior side walls of the attache' case so that it will not slip or slide. It may, for example, be in the range of 2½ to 4 inches in height. The block 18 has a plurality of food receiving cavities, such as cavities 20 through 26, formed into one of its major surfaces. As illustrated, and used, the major surface into which the cavities are formed is then utilized as the top of the insulative block 18.

Figure 2:
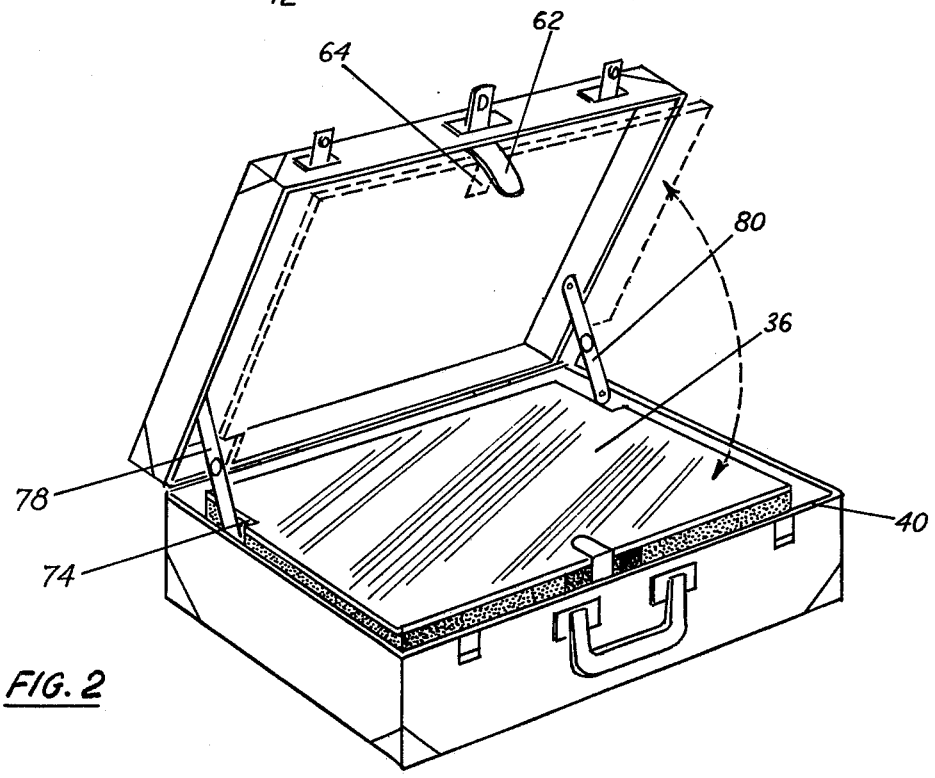
FIG. 2 is a view in perspective of the embodiment illustrated in FIG. 1 showing the lid in a closed position.
Figure 3:
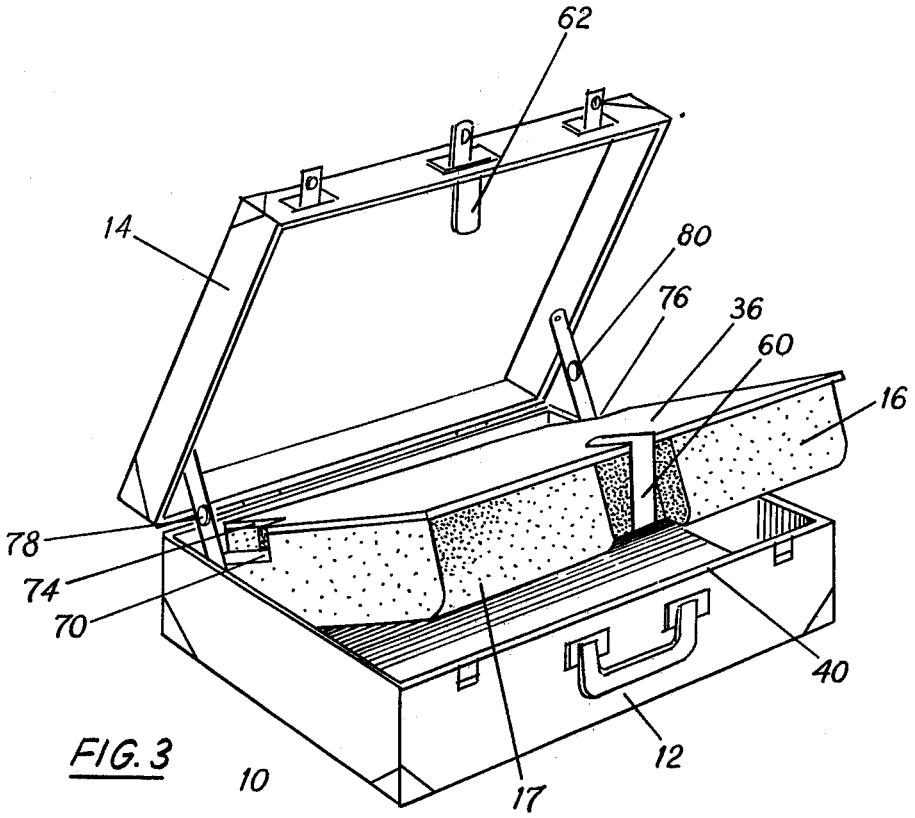
FIG. 3 is a view in perspective showing the insert partially withdrawn from the attache' case.

The insert 16 is also provided with a covering lid 28 which is pivotally or hingedly mounted to the rear portion of the insulative block 18 for protectively covering and retaining food items in the food receiving cavities when closed as illustrated in FIG. 2. The covering lid 28 extends nearly into contact with the side walls of the attache' case in order to conceal the insulative block. However, a clearance of 1/16 inch is provided to avoid interference with opening of the lid 28 or removal of the insert 16.

It is significant to the present invention that the insert 16 be removably mounted in the attache' case 10 so that it can be easily removed without requiring the use of tools in order that it can be cleaned, filled and if desired placed in the refrigerator with or without food in it. While it is preferred that the insert 16 merely rest unattached in the attache' case 10, alternatively it may be desirable to provide a releasable latching means in the attache' case and on the insert 16. Such latching means might, for example, include a magnetic device, mating pressure sensitive materials such as Velcro or a mechanical, releasable, latch mechanism.

As illustrated in FIG. 2, we prefer to dimension the insert 16 so that it occupies the majority of the main base member 12 of the attache' case but allows for a space above the insert and within the hinged top of the attache' case for use in the storage and transport of business papers. It should be understood, however, that as an alternative the insert 16 could be larger or advantageously could be smaller so that a portion of the main base member of the attache' case would also be available for carrying articles or papers.

Figure 4:
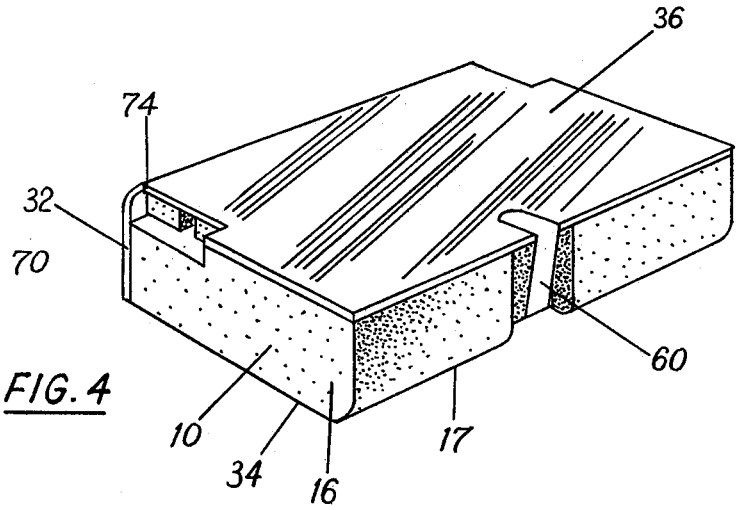
FIG. 4 is a view in perspective of the insert of FIG. 1 removed from the attache' case.

As shown in FIG. 4, the forward lower edge 17 is curved, or alternatively could be bevelled, in order to facilitate the lowering of the insert into the attache' case by providing additional clearance between the forward lower edge 17 of the insert 16 and the forward upper edge 40 of the main base member 12 of the attache' case 10.

Preferably the insulative block 18 is formed from a closed cell, polyethylene foam which is fairly rigid but does have some resilience. In order to facilitate manufacture and to provide a neat and trim product, it is desirable to form the block 18 of a plurality of polyethylene foam lamina which are bonded together. The laminated block 18 will have at least one lamination with portions removed clear through its thickness to form the cavities 20 through 26. Depending upon the thickness of the lamina, it may be desirable to have several such laminations formed with cut out regions so that when bonded together the cut out regions of adjacent lamina align in registration to form the cavities of the block 18. Cavities of different depths can be formed by cutting through fewer laminations. Then a bottom layer is bonded to the others to form an insulative bottom closing off the bottom of the cavities 20 through 26.

It is attractive to coat the exterior surfaces of the polyethylene foam block 18 with a silk or velour-like coating or surface by means of conventional processes. However, such a coat in the cavities 22 and 26 is avoided because the cavities are most subject to wear by the insertion and removal of food containers.

A sheet or layer 30 of similar insulative material is bonded over the underside of the covering lid 28 both to provide an insulative wall above the food items stored in the cavities 20 through 26 and also to seat against food containers in the cavities and compressibly retain the food containers in the cavities. Consequently, we have found it desirable that the insulative foam layer 30 mounted beneath the lid 28 have greater resilience than the foam of the insulative block 16.

The covering lid 28 is itself preferably formed by a cardboard, fiberboard or aluminum sheet or other relatively lightweight stiffening layer which is covered by leather, simulated leather or other suitable covering or upholstery material. Preferably, this covering material matches or coordinates well with the exterior of the attache' case. It extends not only over the top of the covering lid 28 but additionally around behind the rear surface 32 of the block 18 as illustrated in FIG. 4 and beneath the underside 34 of the block 16.

In this manner the top surface 36 of the insert 10 is both attractive, sufficiently smooth and flat to form a convenient and handy writing work surface and disguises or conceals the functional nature of the insert 16.

Further, it is advantageous to hinge the covering lid 28 to the insulative block 18 by means of a bookbinding, backbone, hinge structure of the type which is commonly used for hard covered books. It may in fact be desirable to design the exterior of the insert 16 so that it has the appearance of a book.

Figure 5:
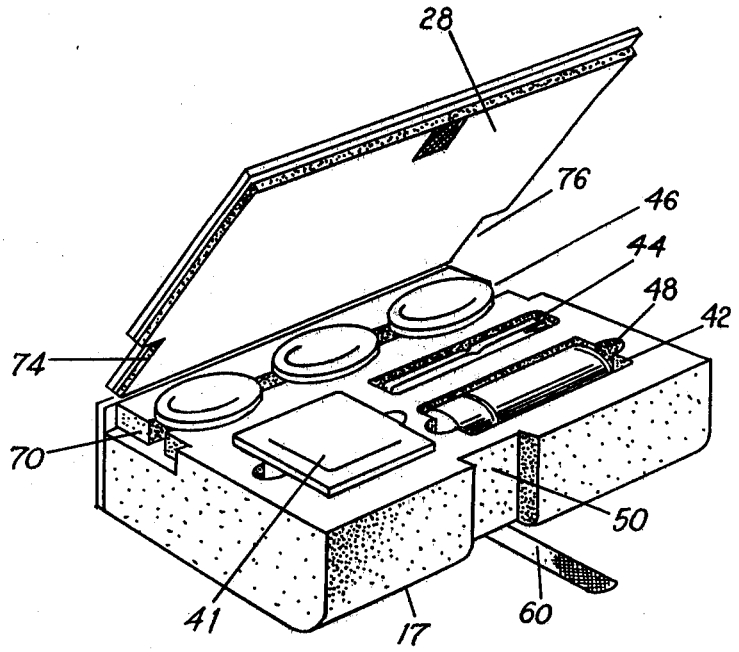
FIG. 5 is a view in perspective of the insert illustrated in FIG. 4 with the lid shown in its open position and the food and beverage containers and utensils stored in the appropriate cavities.

Referring now to FIG. 5, it is desirable that cavities 20 through 26 are formed in such a shape and size that they will matingly receive the beverage and food containers in order to retain these food containers snugly within the cavities. The selection of the particular cavities and the size and shape of each is a matter of choice. Preferred, however, are three relatively cylindrical cavities for three similarly shaped general purpose food containers some of which may themselves be insulated and of a type which are commercially available. Further, it is convenient to include a relatively rectangular cavity for receipt of similarly shaped polyethylene container 41 advantageously having a pressure sealable or snap-on top. The lid of the container 41 protrudes above the top surface of the insulative block 18 so that the lid of the container 41 will be forced more firmly against the lower part of the container 41 by the underside of the insert covering lid 28 to assure an effective seal. Preferably all of these containers are dishwasher acceptable and microwave oven compatible. A relatively elongated rectangular cavity 42 for receipt of a conventional Thermos bottle and a cavity 44 for receipt of appropriate eating utensils are also formed in the insert 16.

For convenience, finger receiving spaces such as notches 46 and 48 are cut away so that the user's fingers can easily be inserted into the food receiving cavities to grasp the food containers and remove them. A similar finger hole 50 is provided at the forward edge of the block 18 to facilitate removing the insert from the attache' case.

Notches 70 and 72 are formed in the upper, rear sides of the insulative block 18 to provide clearance for the receipt of the attache' case hinges 78 and 80. Notches 74 and 76 are formed at the rear, side edges of the lid 28 to allow a similar clearance.

In order to hold the covering lid 28 tightly and protectively closed during storage or transportation, pressure sensitive latching means are provided. For example, a Velcro strip 60 is attached to the underside of the insulative block 18 as shown in FIG. 5 and a similar strip or tab of Velcro of the same gender is attached to the underside of the top 14 of the attache' case 10. Mating pieces of the opposite gender are attached one, strip 64, to the underside of the covering lid 28 at its forward edge and another to the top surface immediately above the strip 64. Consequently, as shown in FIG. 4, when the covering lid 28 is closed, the strip 60 can be used to retain it in the closed position. However, during the loading of the insert 16 at the beginning of the day or the removal of foods at lunch time, the lid 28 may be latched in the open position by pressing the tab 62 against the mating strip 64.

Use of the polyethylene insulative foam and the structure of the insert described above permits a person to cut off or trim an end of the insert in order to enable it to fit into a small briefcase or to provide additional space for carrying other articles.

From the above description it can be seen that, with an embodiment of the present invention, the owner has an attache' case which is always available for carrying papers and additionally is available when desired on a temporary basis for the carrying of food. The food carrying insert of the present invention may be easily removed at the end of the day, opened and placed under running water and thoroughly washed and dried. Food items, such as sandwiches, for the next day can then be placed in the insert and the entire packed insert than may be placed in the refrigerator and kept fresh until the next day.

Then, in the morning the insert may be removed from the refrigerator and containers of hot items may be inserted if desired and the entire insert then positioned in the attache' case as the person leaves the home and begins traveling to work.

If the person is traveling in public transportation or if he is riding in a car-pool then the travel time may be put to good advantage by permitting the attache' case to be opened and used as a portable desk. Not only can additional work be accomplished but during the travel the actual food carrying function of the insert will not be apparent to fellow travelers.

The person then carries the embodiment of the present invention into his office where it remains available to satisfy his appetite entirely at his convenience.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

We claim:

1. A food carrying attache' case comprising:

(a) an attache' case including a main base member and a top hingedly secured thereto at co-extensive edges;

(b) a block of insulative material removably positioned in said base member, said insulative material having a plurality of food receiving cavities formed into one of its major surfaces which faces said top; and (c) a covering lid above said major surface of said block of insulative material and pivotally mounted thereto for, at times, protectively covering and retaining food in said cavities, said cover lid having an exterior top surface which is sufficiently smooth and flat to form a writing work surface and which is spaced from the interior of said top when said top is closed, first pressure responsive means for holding said lid in an open position when said lid is opened, and second pressure responsive means for holding said lid on said block and retaining food in said cavities when said lid in closed.

2. A case according to claim 1 wherein a said first and second pressure responsive means comprising a pressure sensitive multi-part latching means is provided, one part on the edge of said lid opposite the pivoted edge and mating parts on the interior of said top for securing said lid in an open position when said top is opened and on said block for securing said lid against said block for retaining food in said cavities.

3. A case according to claim 1 wherein the underside of said lid is covered with a layer of resilient, insulative foam for compressibly retaining food containers in said cavities.

* * * * *